US006466760B2

(12) United States Patent
Mizuno

(10) Patent No.: US 6,466,760 B2
(45) Date of Patent: Oct. 15, 2002

(54) DEVELOPMENT DEVICE AND DEVELOPMENT METHOD, AND IMAGE-FORMING DEVICE

(75) Inventor: Tsuneo Mizuno, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/765,435

(22) Filed: Jan. 22, 2001

(65) Prior Publication Data

US 2001/0055502 A1 Dec. 27, 2001

(30) Foreign Application Priority Data

May 26, 2000 (JP) ..... 2000-155644

(51) Int. Cl.[7] ..... G03G 15/08
(52) U.S. Cl. ..... 399/284
(58) Field of Search ..... 399/284, 285, 399/274; 118/261; 430/120

(56) References Cited

U.S. PATENT DOCUMENTS

| | | | | |
|---|---|---|---|---|
| 5,543,902 A | | 8/1996 | Takeda et al. | |
| 5,600,419 A | * | 2/1997 | Sakuraba et al. | 399/285 |
| 5,761,589 A | | 6/1998 | Kido et al. | 399/284 |
| 5,761,590 A | * | 6/1998 | Sato | 399/285 |
| 6,006,060 A | * | 12/1999 | Sato | 399/284 |
| 6,154,627 A | * | 11/2000 | Iwamatsu et al. | 399/286 |

FOREIGN PATENT DOCUMENTS

| | | | | |
|---|---|---|---|---|
| JP | 54-111358 | | 8/1979 | |
| JP | 57-104162 | * | 6/1982 | |
| JP | 58-153972 | | 9/1983 | |
| JP | 5-11599 | | 1/1993 | |
| JP | 05289485 A | * | 11/1993 | G03G/15/08 |
| JP | 6-186834 | | 7/1994 | |
| JP | 8-248767 | | 9/1996 | |
| JP | 11-007198 | * | 1/1999 | |

* cited by examiner

*Primary Examiner*—Robert Beatty
(74) *Attorney, Agent, or Firm*—Armstrong, Westerman & Hattori, LLP

(57) ABSTRACT

A development device includes: a development roller a surface of which is made of electrically resistant material; a blade that comes in contact with the development roller so as to form a layer of developing agents, and has a predetermined thickness on the development roller, and possesses electrical conductivity; a bias power supply that applies a bias to the development roller and the blade; and a resistance provided between the blade and the development bias supply to establish electric connection therebetween. The resistance may be incorporated in the blade itself.

7 Claims, 6 Drawing Sheets

DEVELOPMENT DEVICE AND DEVELOPMENT METHOD, AND IMAGE-FORMING DEVICE

BACKGROUND OF THE INVENTION

The present invention relates generally to image-forming devices, and more particularly to a development device and development method for use with an electrophotographic image-forming device. The present invention also relates, for example, to a development method using a nonmagnetic monocomponent developing agent, development roller, and a blade that regulates a layer thickness of the nonmagnetic monocomponent developing agents on the development roller, and to a method of forming a layer thickness of the nonmagnetic monocomponent developing agents, on a development device wherein the development device has the development roller and the blade, and an electrophotographic image-forming device including one or more of these elements. However, it is to be understood that the scope of application of the present invention is not limited to devices using the nonmagnetic monocomponent developing agent.

The "nonmagnetic monocomponent developing agent" is a single component developing agent that is not magnetized and includes no carrier. The "electrophotographic image-forming device" is an image-forming device employing the Carlson process described in U.S. Pat. No. 2,297,691, as typified by a laser printer, and denotes a nonimpact printer that provides recording by depositing developing agents as a recording material on a recordable medium (e.g., printing paper, and OHP film).

The nonmagnetic monocomponent developing agent commonly includes the toner having a relatively high volume resistivity (e.g., at 300 GΩ·cm, etc.). In addition, the toner, since it basically carries no electric charge, needs to be charged by the triboelectricity or charge injection in the development device.

With the recent development of office automation, the use of electrophotographic image-forming devices for computer output devices, facsimile units, photocopiers, etc. have spread steadily. Particularly, a laser printer as one example of the electrophotographic image-forming devices features good operability, usability for a wide range of media, high cost efficiency, and high printing quality, whereby a further improvement in high-quality and high-speed printability will be expected in future. The electrophotographic image-forming device generally includes a photoconductive insulator (photoconductor; photosensitive drum), and follows the procedural steps of charging, exposure to light, development, transfer, fixing, and other post-processes.

The charging step uniformly electrifies the photosensitive drum (e.g., at −700 V). The exposure step irradiates a laser beam, or the like, on the photosensitive drum, and changes the electrical potential at the irradiated area down, for example, to −50 V or so, forming an electrostatic latent image. The development step electrically deposits developing agents onto the photosensitive drum using, for example, the reversal process, and visualizes the electrostatic latent image. The reversal process is a development method that forms an electric field by a development bias in areas where electric charge is eliminated by exposure to light, and deposits the developing agents having the same polarity as uniformly charged areas on the photosensitive drum by the electric field. The transfer step forms a toner image corresponding to the electrostatic latent image on a recordable medium. The fixing step fuses and fixes the toner image on the medium using heat, pressure, or the like, thereby obtaining a printed output. The post-processes may include charge neutralization and cleaning on the photosensitive drum from which toner has been transferred out, a collection and recycle and/or disposal of residual toner, etc.

The developing agent for use with the aforementioned development step can be broadly divided into a monocomponent developing agent using toner and a dual-component developing agent using toner and a carrier. The toner may include a particle prepared, for example, in such a manner that a colorant, such as a dye and carbon black, or the like, is dispersed in a binder resin made of synthetic macromolecular compound, and then is ground into a fine powder of approximately 3 through 15 μm. A usable carrier may include, for example, an iron powder or ferrite bead of approximately 100 μm diameter. The monocomponent developing agent advantageously results in (1) simple and miniature equipment for the development device due to eliminating carrier deterioration, a toner density control, mixing, and agitation mechanisms, and (2) no residual waste, such as a carrier in used toner.

The monocomponent developing agent may be further classified into a magnetic monocomponent developing agent that includes a magnetic powder in toner, and a nonmagnetic monocomponent developing agent that does not include the same. However, the magnetic monocomponent developing agent is disadvantageous in: (1) low transfer performance due to the high content of low electrical resistant magnetic powder which hinders the increased electric charge amount; (2) bad colorization due to its low transparent, black-color magnetic powder; and (3) low fixing performance due to the magnetic powder which requires high temperature and/or high pressure, thereby increasing a running cost. Accordingly, the nonmagnetic monocomponent developing agent without these disadvantages is expected to be in increasing demand in future.

The development method employing the nonmagnetic monocomponent developing agent is divided into two development methods: one is a contact-type development method that deposits developing agents on the photosensitive drum by bringing the development roller carrying the developing agents into contact with the photosensitive drum; and the other is a jumping development method (noncontact-type development method) that provides a certain gap (e.g., of about 350 μm) between the development roller and the photosensitive drum to space them from each other, and flies the developing agents from the development roller to, and deposits the same onto, the photosensitive drum.

It is significant for the development process employing the nonmagnetic monocomponent developing agent to ensure a sufficient image density by controlling the amount of toner conveyed from the development roller to the photosensitive drum. Thus, it is very important to form a specified toner layer while controlling its thickness on the development roller. As a typical method for regulating a toner layer thickness, it has conventionally been proposed to provide a blade (restriction blade) in contact with the development roller to maintain the layer thickness uniform.

Referring now to FIG. 8, a description will be given of a contact-type development device 10 using a nonmagnetic monocomponent developing agent. FIG. 8 is a schematic sketch of a principal part of the conventional development device 10 for explaining a bias applied to the development device 10. As shown in FIG. 8, the development device 10 includes a development roller 12, a reset roller 14, and a blade 16. The development roller 12 adsorbs onto a surface thereof charged toner as a thin layer, and conveys the toner to a development area in contact with the photosensitive drum. The development roller 12 is connected with a bias power supply (not shown) that applies a development bias $V_b$. The reset roller 14, which is also called a supply roller or application roller, contacts the development roller 12 and serves to supply toner to the development roller 12. Further the reset roller 14 also serves to scrape off and remove the toner unused for the development and remaining on the development roller 12. As shown in FIG. 8, a reset bias $V_r$ is applied to the reset roller 14.

The blade 16 is brought into contact with the development roller 12, and serves to regulate the toner layer to a uniform thickness. In order to avoid damaging the blade 16 and the development roller 12 by mitigating the accuracy in contact pressure required at the contact portion therebetween, it is so devised that one of them is made of an elastic body when the other is made of a rigid body. For example, when a metal member, namely a rigid member, is used for the development roller 12, the toner layer may be regulated by bringing the blade 16 made of an elastic body, such as rubber, into contact with the development roller 12. On the other hand, when a member made of an elastic body, such as rubber, is used for a surface of the development roller 12, the toner layer may be regulated by bringing an end portion or non-end portion of the blade 16 made of metal into contact with the development roller 12. However, the blade 16 made of an elastic body, such as rubber, would be abraded (worn) by repeated development operations, and thus the number of sheets that can be printed would disadvantageously be limited to ten through twelve thousand sheets. Therefore, the use of the metal blade 16 resistant to abrasion has recently received attention.

The metal blade made of stainless steel (SUS) can inject charges into toner by a blade bias $V_{db}$ applied to the blade, as shown in FIG. 8. According to the conventional development device, the reset bias $V_r$ and the blade bias $V_{bd}$ share a bias power supply (not shown) in order to avoid an increase in costs with the increasing number of power supplies. The bias voltages applied to each element 12 through 16 may, for example, be set as follows: the development bias $V_b$ is −300 V; the reset bias $V_r$ is −400 V; and the blade bias $V_{bd}$ is −400 V.

A toner layer on the development roller, if too thin, would result in a low and uneven image density, while, if too thick, would increase a proportion of oppositely charged or low charged toner, thereby producing a fog in a no-image area (i.e., undesirably coloring with the toner an area which has no image and is therefore expected to be white clarity). Thus, the blade 16 is required to form a toner layer having an appropriate thickness.

In development operation, the toner is charged (e.g., negatively) through sliding friction among the reset roller 14, the blade 16, and the development roller 12. The negatively charged toner thereafter is fed onto a surface of the development roller 12 by the reset roller 14, and deposited thereon by electrostatic adsorption. Subsequently, the toner layer on the development roller 12 is leveled using the blade 16 to form a thin layer having a uniform thickness of about 10 $\mu$m through 40 $\mu$m. The toner is conveyed from the photosensitive drum to the development roller 12, and adsorbed to an electrostatic latent image on the photosensitive drum with the electrical force of attraction using a predetermined voltage applied to a development area. Consequently, the latent image is visualized and developed. Next, the residual toner unused for the development and remaining on a no-image area of the development roller 12 in which no latent image is formed is removed by the reset roller 14 from the development roller 12. The development process repeats a series of these operations.

However, the conventional contact-type development method employing a nonmagnetic monocomponent developing agent disadvantageously produces images having a variety of image quality according to the development conditions. The present inventors first elaborately studied the causes that would deteriorate the image quality, and resultantly found out that the image quality depends upon a change of the toner charge amount.

In the aforementioned development process, a toner charge amount depends on the charge injection by the blade 16. When a toner layer is formed on the development roller 12 but not developed, the toner layer is configured to be flaked off from the development roller 12 by the reset roller 14, but actually, a considerable amount of the toner is left and conveyed to, and brought into contact with, the blade 16 again, and additional charges are thereby injected, increasing the toner charge amount. Consequently, the toner is separated from the development roller 12, which may make it difficult for the toner to be adsorbed onto the photosensitive drum, and thus produce image retention (area-to-area variations in image density). In addition, when a solid image (an image of which an entire area to be printed is filled in) is developed, an image density on a first printed output would disadvantageously become low, and thereafter the image density would increase as the cycle of rotation of the development roller 12 proceeds.

As the number of printed sheets increases, the toner is degraded, and a charging capability (charge amount) of toner decreases; therefore negatively charged toner deposited on the development roller increases so as to compensate for a potential difference between the metal blade 16 (at −400 V) and the development roller 12 (at −300 V). Consequently, the amount of charges applied to a unit amount of toner decreases (or charge injection effect decreases), and thus the toner charge amount further decreases, disadvantageously producing a fog.

The above-described disadvantages derived from a variation of the toner charge amount would be eliminated in principle by equalizing the potentials of the development roller 12 and the blade 16, and dispensing with the charge injection from the blade 16 to the toner. In other words, the development bias $V_b$ and the blade bias $V_{bd}$ may be adjusted to the same potential, and according to this adjustment, almost all of the toner is charged only by friction between each toner particle, or triboelectricity by the reset roller 14, and thus is not charged by the charge injection into the toner. However, a surface of a toner layer charged by friction comes in contact with the blade 16, and thus is further charged by friction. Accordingly, an area of the surface of the toner layer in contact with the blade 16 has a higher potential than the blade 16 by the amount of potentials increased by friction with the blade 16, and thus a potential difference occurs, so that an oppositely charged toner is produced. The oppositely charged toner denotes toner having a charge opposite in polarity to a charge that works effectively in the development process. As a result, even if the development roller 12 and the blade 16 have the same potential, the oppositely charged toner exerts an influence on toner layer, and increases the susceptibility to fogging.

BRIEF SUMMARY OF THE INVENTION

Accordingly, it is an exemplified general object of the present invention to provide a novel and useful development device, development method, and image-forming device, in which one or more of the above-described conventional disadvantages are eliminated.

Another exemplified and more specific object of the present invention is to provide a development device, development method, and image-forming device that can more stably form a high-quality image than was previously possible by a cost-efficient means for stabilizing a toner charge amount, and forming a toner layer having reduced dependence on the toner charge amount.

In order to achieve the above objects, the development device as one exemplified embodiment of the present invention comprises: a development roller, a surface of which is made of electrically resistant material; a blade that comes in contact with the development roller so as to form a layer of developing agents, has a predetermined thickness on the development roller, and possesses electrical conductivity; a bias power supply that applies a bias to the development roller and the blade; and a resistance provided between the blade and the development bias supply to establish electric connection therebetween. According to this development device, the blade is connected with the resistance, and thus can discharge the excessively charged developing agents. Therefore, the charge amount of the developing agents becomes stable, and the toner layer formation becomes preferable.

The development method as one exemplified embodiment of the present invention comprises: a reset roller to which a current voltage is applied feeding developing agents to a development roller to which a current voltage is applied, by utilizing a potential difference; bringing a blade to which a current voltage is applied into contact with the development roller, and forming a uniform layer of the developing agents charged by triboelectricity, the blade being connected with a resistance; a development process of feeding the developing agents from the development roller disposed in contact with the photosensitive drum to the photosensitive drum, and visualizing an image with the developing agents on the photosensitive drum; and the reset roller collecting residual developing agents on the development roller utilizing a potential difference, wherein the resistance ranges between 50 kΩ and 100 MΩ. This development method has the same actions as the above development device.

The image-forming device as one exemplified embodiment of the present invention comprises a photosensitive drum; a charger that charges the photosensitive drum; an exposure part that exposes the surface of the photosensitive drum charged by the charger to light, and forms an electrostatic latent image; a development device that develops the surface of the photosensitive drum exposed to light, and visualizes the electrostatic latent image into a toner image; and a transfer part that transfers the toner image onto a recordable medium, wherein the development device comprises: a development roller a surface of which is made of electrically resistant material; a blade that comes in contact with the development roller so as to form a layer of developing agents, and has a predetermined thickness on the development roller, and possesses electrical conductivity; a bias power supply that applies a bias to the development roller and the blade; and a resistance provided between the blade and the development bias supply to establish electric connection therebetween. Alternatively, the above development device comprises a development roller a surface of which is made of electrically resistant material; a blade that comes in contact with the development roller so as to form a layer of developing agents, and has a predetermined thickness on the development roller; a bias power supply that applies a bias to the development roller and the blade; and an elastic resistant material that is directly electrically connected with the development bias power supply, and makes up the blade. This image-forming device includes the above development device, and thus exerts the same action as the development device.

Other objects and further features of the present invention will become readily apparent from the following description of the embodiments with reference to accompanying drawings.

DETAILED DESCRIPTION OF THE INVENTION

Figure 1:
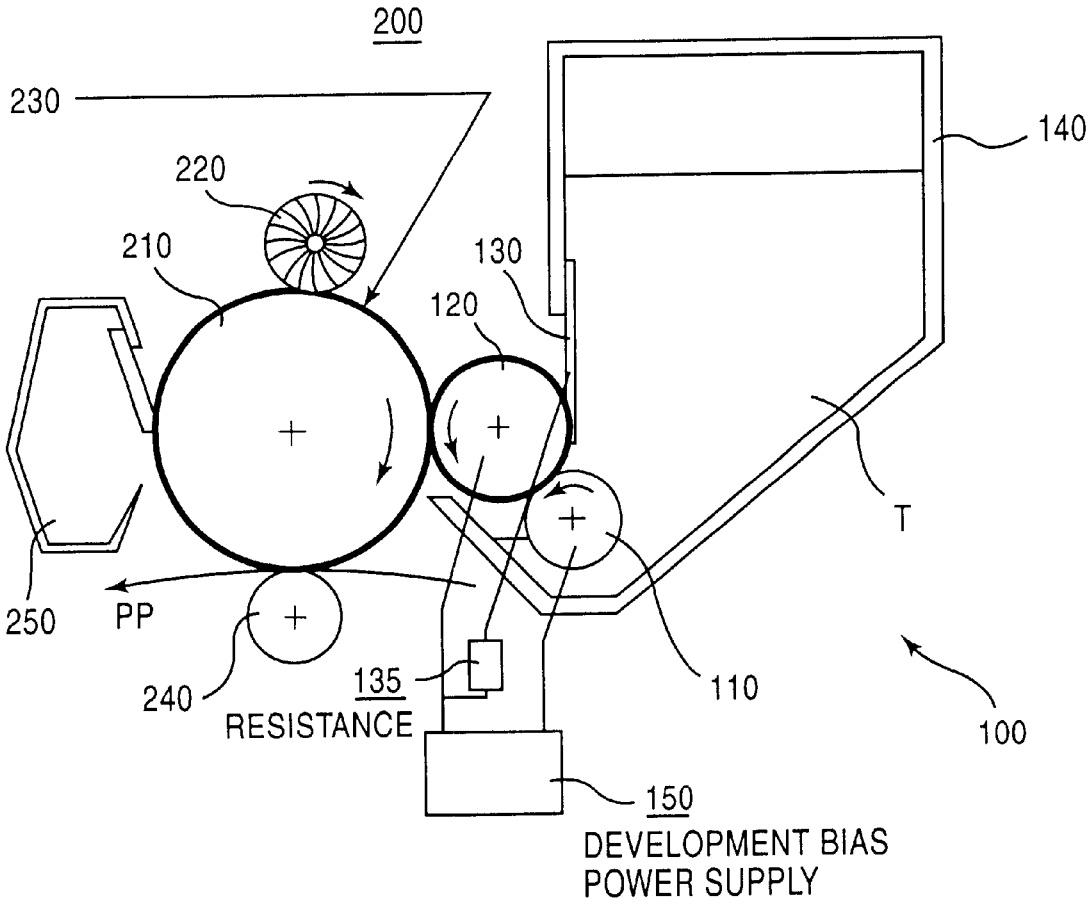
FIG. 1 is a partial sectional view of a principal part of a development device and an image-forming device as one exemplified embodiment of the present invention.
Figure 2:
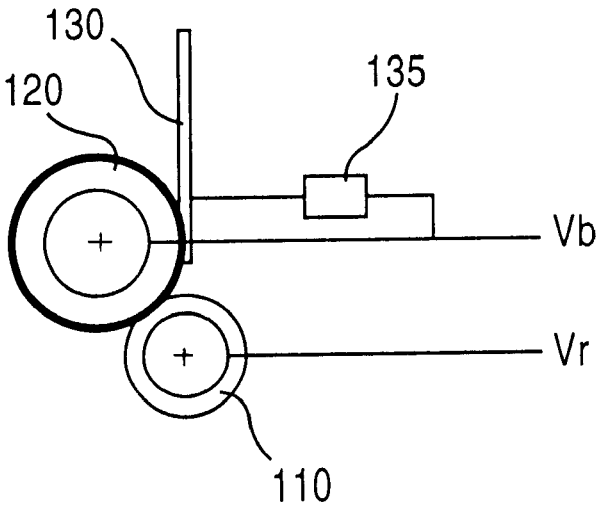
FIGS. 2 and 2(*a*) are schematic sketches of principal parts of embodiments of the development device shown in FIG. 1 for explaining a bias applied to the development device.
Figure 2A:
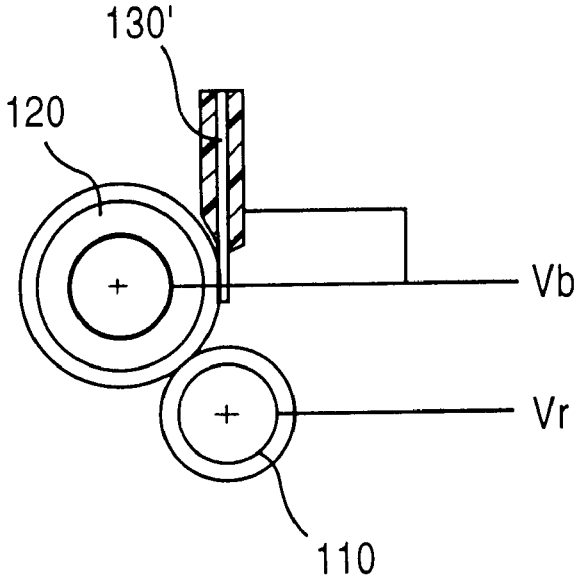

A description will now be given of a development device 100 and an image-forming device 200 having the development device 100 as one exemplified embodiment of the present invention with reference to FIGS. 1 and 2. In each figure, those elements designated by the same reference numerals denote the same elements, and a duplicate description thereof will be omitted. Hereupon, FIG. 1 is a schematic sectional view of a principal part of the image-forming device 200 including the development device 100. FIG. 2 is a schematic sketch of a principal part of the development device 100 for explaining a bias applied to the development device 100. The development device 100 includes a reset roller 110, a development roller 120, a blade 130, a frame 140, and a development bias power supply 150.

The reset roller 110, which is also called a supply roller or application roller, contacts the development roller 120 and supplies toner T from the frame 140 to the development roller 120. The reset roller 110 is configured to electrify the toner T by friction between the development roller 120 and the reset roller 110, and is thus made of an electrically conductive material, such as sponge. In the present embodiment as shown in FIG. 1, the reset roller 110 rotates to the left (counterclockwise), and is brought into contact with the development roller 120. Utilizing this contact and rotation, the toner T is charged and supplied to the development roller 120. The reset roller 110 may also serve to collect the residual toner T unused for the development and left on the development roller 120. When the toner T is collected, the toner T is scraped off from a surface of the development roller 120 utilizing the contact of the both rollers 110 and 120, and returned into the frame 140.

The development roller 120 adsorbs the toner T onto the surface thereof, and, in rotating, conveys the toner T to a surface of the photosensitive drum 210 in contact with the development roller 120. The development roller 120, for instance, rotates at a circumferential velocity 1.15 times faster than that of the photosensitive drum 210, in the same direction as the surface of the photosensitive drum 210. In the present embodiment, the development roller 120 is made of an elastic electrically resistant material of solid rubber (nitril rubber: NBR) having an outer diameter of 20 mm and hardness of 41, but a usable material is not limited thereto, and may be made of an urethane resin or the like. The development roller 120 is coated with a surface coating layer, such as metamorphic silicon and urethane resin having an approximate size of 5 $\mu$m through 20 $\mu$m. The coating layer may be prepared by adding oxide metal materials such as titanium oxide and magnesium oxide, to adjust properties of the coating layer to those of the toner T. According to this composition, the blade is engaged into the development roller 120, to regulate a layer thickness of the toner T.

An experiment was carried out for the present embodiment in which the reset roller 110 was brought into contact with the development roller 120 at the contact depth of 1 mm, and the both rollers were rotated to the left. Accordingly, the reset roller 110 and the development roller 120 were rotated opposite in direction to each other at their contact point. The reset roller 110 has a structure having a metal shaft coated with electrically conductive urethane foam, with an outer diameter of 20 mm, and resistance between the shaft and the sponge (urethane foam coating) is adjusted to $10_7$ Ω. The rotation speed of both the reset roller 110 and the development roller 120 were adjusted to 103.5 mm/s.

The blade 130 is a member serving to restrict to a predetermined thickness the toner T supplied by the reset roller 110. The blade 130 also serves to charge the toner T by sandwiching the toner T between the blade 130 and the development roller 210 and applying friction to the toner T conveyed by the development roller 120. In addition, a potential may be applied to the blade 130, and charges may be injected into the toner T through the blade 130. This blade 130 may be made of a variety of materials such as an elastic body typified by urethane, etc., and metal having leaf spring properties such as stainless steel and phosphor bronze. A method of regulating the toner T varies with materials of the blade 130, which includes scraping off, pressurizing with an end-portion or midsection thereof or the like. In the present embodiment, the blade 130, for which a stainless steel member (SUS304 or SUS303) having a plate thickness t of 0.1 mm is prepared, adopts a midsection contact method in which a midsection of the blade 130 may be brought into contact with the development roller 120 at a predetermined line pressure.

As shown in FIG. 2, predetermined biases are applied to the reset roller 110, the development roller 120, and the blade 130 to form a toner layer TL. The biases applied to each element is respectively a reset bias $V_r$, a development bias $V_b$, and a blade bias $V_{db}$. However, the formation of the toner layer TL depends upon the toner charge amount as described above, and it has turned out that a stabilized toner charge amount is required to form a high-quality image.

The stabilized toner charge amount may be achieved by equalizing potentials of the development roller 120 and the blade 130, eliminating charge injection from the blade 130 into the toner T, and charging the toner T only by triboelectricity. However, on a surface of the toner layer TL charged by triboelectricity, oppositely charged toner T would be produced, which would disadvantageously increase susceptibility to produce a fog even if the potentials of the development roller 120 and the blade 130 were equalized. Therefore, the inventive development device 100 is configured to establish connection between the blade bias $V_{db}$ and the development bias $V_b$ via the resistance 135 so as to discharge, and thereby prevents the oppositely charged toner T from occurring.

Figure 3:
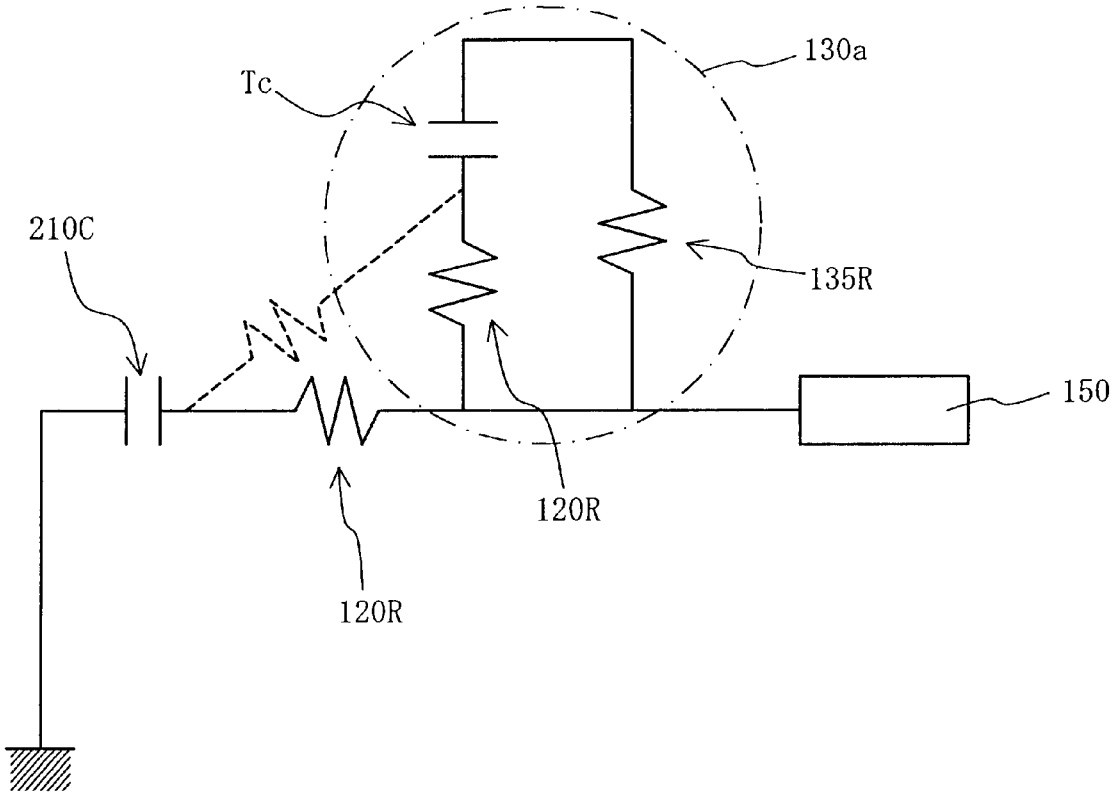
FIG. 3 is a schematic equivalent circuit diagram for electrically explaining the development device shown in FIG. 1.

A description will now be given of the toner layer TL formed on the development roller 120 with reference to Table 1 and FIG. 3. Table 1 is a table for comparing electrical properties of the toner T and the development roller 120 used in this embodiment. FIG. 3 is a schematic equivalent circuit diagram for electrically explaining the development device 100 according to the present invention.

TABLE 1

| | Volume resistance [Ω · cm] | Relative dielectric constant [–] | Time constant [s] |
|---|---|---|---|
| Toner T | $1 \times 10^{13-15}$ | 2.3 | $2.03 \times 10^{2-5}$ |
| Development roller 120 | $1 \times 1^{6-8}$ | 3.0 | $2.65 \times 10^{-4--6}$ |

As shown in Table 1, the toner T has by far larger time constant and larger volume resistance than the development roller 120, which indicates that the toner T as higher capability as a dielectric material than the development roller 120. In other words, the toner T acts like a capacitor having the property of storing electricity, and the development roller 120 correspondingly has the property as an electrically resistant material. Consequently, the toner T is separated from the blade 130 by dielectric polarization, forming a toner layer TL on the development roller 120.

From the electric properties of each element as shown in Table 1. the toner T may be represented by a capacitor, and the development roller 120 by an electrically resistant material. Accordingly, the capacitor $T_c$, shown in FIG. 3 corresponds to the toner T (or toner layer TL), and the electrically resistant material 120R corresponds to the development roller 120. Since surface resistance of the development roller 120 is high, a capacitor 210C comprised of the photosensitive drum 210 and the development roller 120 are insulated as indicated by a dotted line. An area demarcated by a dot-dash line shows a vicinal portion 130*a* of the blade 130, and represents a closed equivalent circuit comprising an electrically resistant material 120R derived from the development roller 120, a capacitor $T_c$, made up of the toner layer TL, and an electrically resistant material 135R made up of the inventive resistance 135. Therefore, even if the toner layer TL stores an initial charge Q, the charge Q is discharged by the electrically resistant materials 120R and 135R, and thus the toner layer TL is not influenced by a bias voltage by the bias power supply 150. The discharge of the charge Q is determined by the time constant τ of C ($R_{120}$+$R_{135}$). C denotes capacitance, $R_{120}$ denotes resistance of the development roller 120, and $R_{135}$ denotes resistance of the resistance 135.

The development device 100 according to the present invention is provided with a resistance 135 between the blade 130 and the development bias power supply 150, and thus constitutes a closed circuit, having a discharging property, so that a stable charge in the toner T and the toner layer TL may be ensured, and the toner layer TL may be stably formed.

The aforementioned value (resistance) $R_{135}$ of the resistance 135 is determined by the time constant τ. For instance, time for passing worked out is 16 ms where a development process speed is 90 mm/s, a nip width between the development roller 120 and the blade 130 is 1.5 mm. Based on this value, the minimum value of the time constant τ for the toner T may be experimentally determined, considering the electrical property of the toner T. For instance, the time constant τ when the toner T and the development roller 120 listed in Table 1 are used may be determined, assuming that no external resistance is provided, as follows. Where the thickness of the toner layer TL is 12 μm, the wall thickness of the development roller 120 is 3 mm, and the resistivity (volume resistance) of the development roller 120 is $1\times10^7$ Ω·cm, the time constant τ is 510 ms. The external resistance $R_{135}$ may be worked out using the time constant τfor each toner T that is used. For the toner T used in the present embodiment, if the development roller of which the resistivity is $1\times10^6$ Ω·cm through $1\times10^8$ Ω·cm, the resistance $R_{135}$ that may provide preferable results may range between 50 kΩ and 100 MΩ. The time constant τ, if sufficiently ensured considering the toner T that is used, may be good enough for stable toner layer TL formation, and the resistance $R_{135}$ may be worked out from the time constant τ.

In the present embodiment, a blade made of stainless steel (SUS304) is used for the blade 130, but, as shown in FIG. 2(*a*), the blade 130 itself may be made of elastic and electrically resistant material. In this case, the blade 130 does not need the resistance 135, and thus is connected directly with the development bias power supply 150. The blade as shown at 130' may also be made of metal (electrically conductive material) partly coated with electrically resistant material. This structure may be formed, for instance, by sticking an electrically resistant sheet on that surface of the metal blade 130 which does not come in contact with the development roller 120. In this case, a metal portion of the blade 130' may be brought into contact with the development roller 120, and the surface coated with electrically resistant material (on which the electrically resistant sheet is stuck) is connected directly with the development bias power supply 150. Accordingly, the present invention may exert the same effects without the resistance 135 equipped by making up the blade 130 of an electrically resistant material, or by adding an electrically resistant property to the blade 130 itself.

The frame 140 stores the toner T, supplies the same to the reset roller 110, and receives the toner T collected by the reset roller 110. The frame 140 includes a paddle, an agitator, and other components (not shown), and is connectible with an external toner storage container such as a toner cartridge. The bias power supply 150 is made up of superposed alternating current power supply and direct current power supply.

The image-forming device 200 as one exemplified embodiment of the present invention, as shown in FIG. 1, includes a photosensitive drum 210, a pre-charger 220, an exposure section 230, and a transfer roller 250. The photosensitive drum 210 includes a photosensitive dielectric layer on a rotatable drum-shaped conductor support, and is uniformly charged by the charger 220. The photosensitive drum 210 is, for instance, made of an OPC to which a function separation-type organic photoreceptor with a thickness of about 20 μm is applied on a drum-shaped aluminum member, has an outer diameter of 30 mm, and rotates at a circumferential velocity of 90 mm/s in the arrow direction.

The pre-charger 220, which is a brush roller charger, uniformly charges a surface of the photosensitive drum 210 at about −700 V. Charges applied by a direct current voltage at −700 V and an alternate current peak-to-peak voltage at 1,150 V (800 Hz) are given to the pre-charger 220. Next, a laser light at 0.24 mw corresponding to a print signal forms an image on the photosensitive drum 210 in the exposure section 230. The photosensitive drum 210 is uniformly charged then, and its uniform potential are partly eliminated, so that areas in which an image is formed by the light may be neutralized (e.g., to −50 V) due to the effects of the above photosensitive dielectric layer, forming a latent image of charge patterns corresponding to light and dark patterns on the original document. The latent image is visualized into a toner image by the development device 100.

In the development device 100, the development roller 120 located in contact with the photosensitive drum 210 rotates at a circumferential velocity 1.15 times faster than and in the same direction as the photosensitive drum 210, and a toner layer TL is formed on the development roller 120 while the blade 30 regulates the toner T supplied from the reset roller 110. The development device 100 according to the present embodiment can stably form the toner layer TL having a uniform charge amount on the development roller 120. The toner T is negatively charged by sliding friction among the reset roller 110, the development roller 120, and the blade 130.

The bias power supply 150 applies a voltage of −400 V to the reset roller 110, and −300 V to the development roller 120. Similarly a voltage of −300 V is applied to the blade 130, which is connected to the resistance 135 of 100 kΩ. Accordingly, the toner T on the development roller 120 has stable charge irrespective of the number of printed sheets, and thus a stable toner layer TL may be formed. Thereafter, the toner layer TL formed on the development roller 120 is deposited onto the electrostatic latent image area on the photosensitive drum 210 using the development bias voltage applied to the development roller 120, and developed. The toner T unused for the development is flaked off with the reset roller 110 rotating below the development roller 120 in an opposite direction, and passing under the reset roller 110, returned to the frame 140. The toner image on the photosensitive drum 210 as obtained in the development device 100 is transferred using the transfer roller 240 onto a sheet of printing paper that is timely conveyed along a paper-conveying path PP by a conveyance roller (not shown). The residual toner T remaining on the photosensitive drum 210 is collected using the cleaner 250. The printing paper that has been printed passes through a fixing section (not shown) to fix the toner thereon, and then is dispensed out.

The toner T was selected from nonmagnetic monocomponent developing agents that are in common use, and prepared, for example, from a polyester resin by kneading fine carbon particles as a colorant, and charge control agents, and then pulverized into particles having a predetermined volume average diameter. Selectively, an offset prevention agent made of a low-molecular-weight material such as wax, polyethylene, and polypropylene may be used for (internally added to) the toner T. Thereafter, a powder smaller than 3 μm and coarse particles equal to or larger than 20 μm were removed, and fine particles of silicon oxide and titanium oxide to provide fluidity and charge were externally added to coat a surface of the remaining particles. This toner T has such thermal characteristics that its glass transition temperature ranges between 55 and 67° C., and its melting point ranges between 120 and 150° C. A large gap between the glass transition temperature and the melting point is due to its broad range of a coating ratio of external additives, a molecular distribution. The toner T is obtainable by not using the above-described pulverizing method, but using any preferred method such as a polymerization process, a spray-drying process and other powder-making processes.

EXAMPLE

An image-formation experiment 1 was carried out using the image-forming device 200 according to the present invention. The reset roller 110 as used herein was a porous material made of a urethane foam having resistance of 10 MΩ, the development roller 120 was an elastic and electrically resistant material made of NBR or nitril rubber having resistance of 10 MΩ, and the blade 130 was electrically conductive material made of stainless steel (SUS304). A direct current voltage as the development voltage bias was applied at −400 V to the reset roller 110, and at −300 V to the development roller 120. Further, a direct current voltage was applied at −300 V to the blade 130, while the resistance 135 was connected between the blade 130 and the development bias power supply 150. A potential at the surface of the photosensitive drum 210 was −700 V, and a potential at the exposed latent image area was about −50 V.

Figure 4:
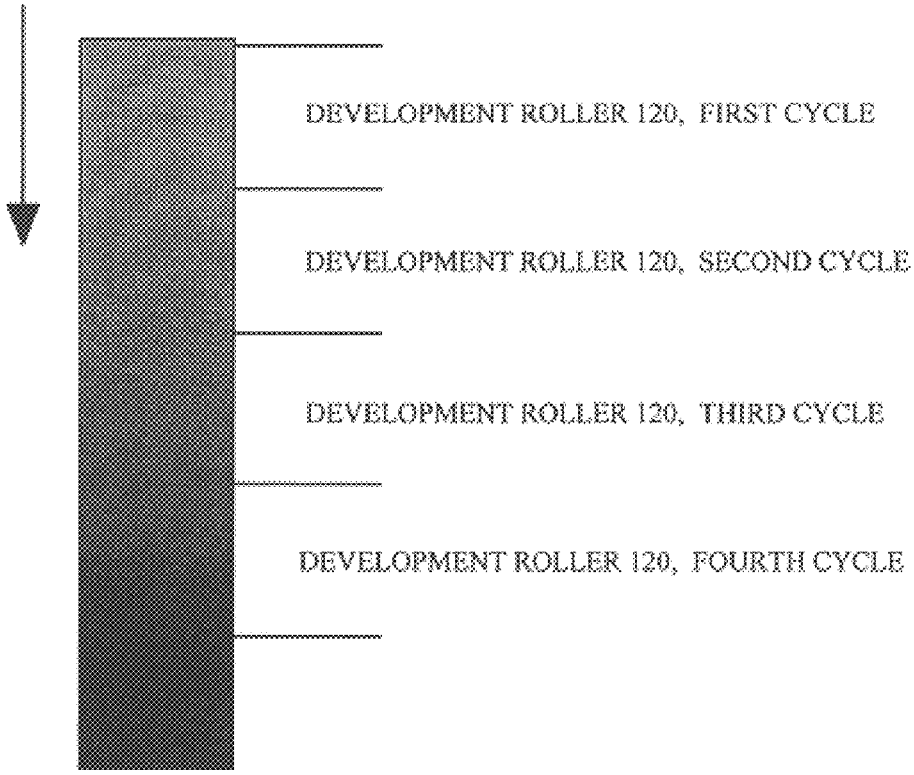
FIG. 4 is a conceptual diagram for showing a solid image density for every cycle of rotation of the development roller.
Figure 5:
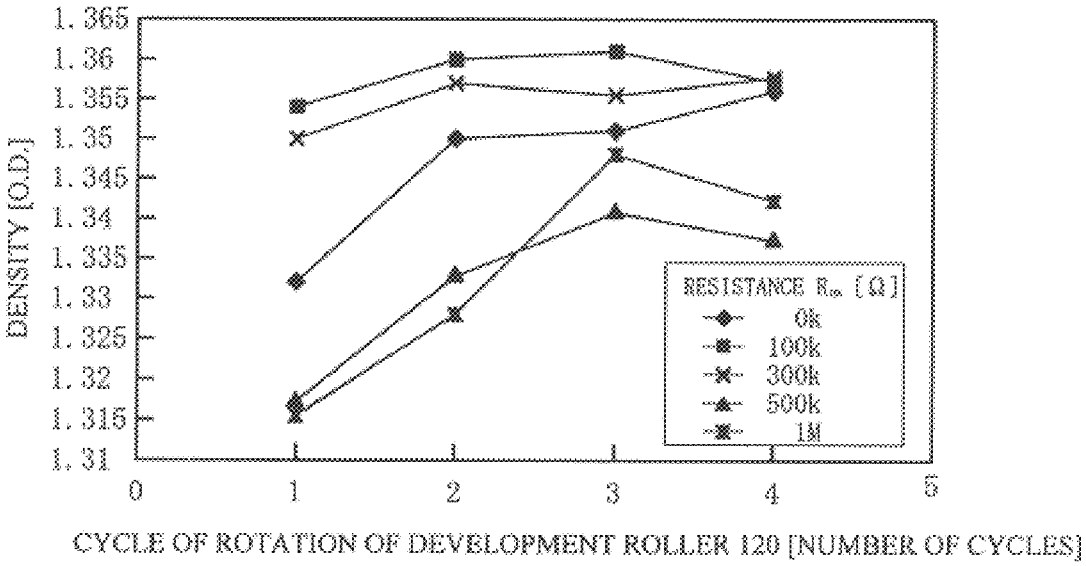
FIG. 5 shows a relationship between a cycle of rotation of the development roller and a solid image density in resistance R.

The same experimental conditions as described above were applied, with the resistance $R_{135}$ varied, and a solid image was formed. The solid image density was measured using the O.D. meter. The results are shown in FIGS. 4 and 5. FIG. 5 also shows results obtained by an image-forming device including the conventional development device 10 having no resistor, for the purpose of comparison. In the conventional development device 10, a direct current voltage was applied as a development voltage bias at −400 V to the reset roller 14, at −300 V to the development roller 12, and −400 V to the blade. The other conditions are the same as the above-mentioned conditions.

FIG. 4 is a conceptual diagram for showing a solid image density for every cycle of rotation of the development roller 120. FIG. 5 shows a relationship between the cycle of rotation of the development roller 120 and a solid image density in resistance R. As seen in FIG. 4, the solid image density rises as the cycle of rotation of the development roller 120 repeats. As seen in FIG. 5, the solid image density in the conventional device made a difference of more than 0.05 between the first cycle and the third cycle. However, when the resistance R was 100 kΩ or 300 kΩ, the difference was within a range between 0.01 and 0.02. In other words, in the inventive image-forming device, if an optimal resistance R can be selected, the solid image density can be kept substantially at a constant level irrespective of the cycle of rotation of the development roller 120. This indicates that the toner charge amount is stabilized, and the toner layer TL is stably formed.

Figure 6:
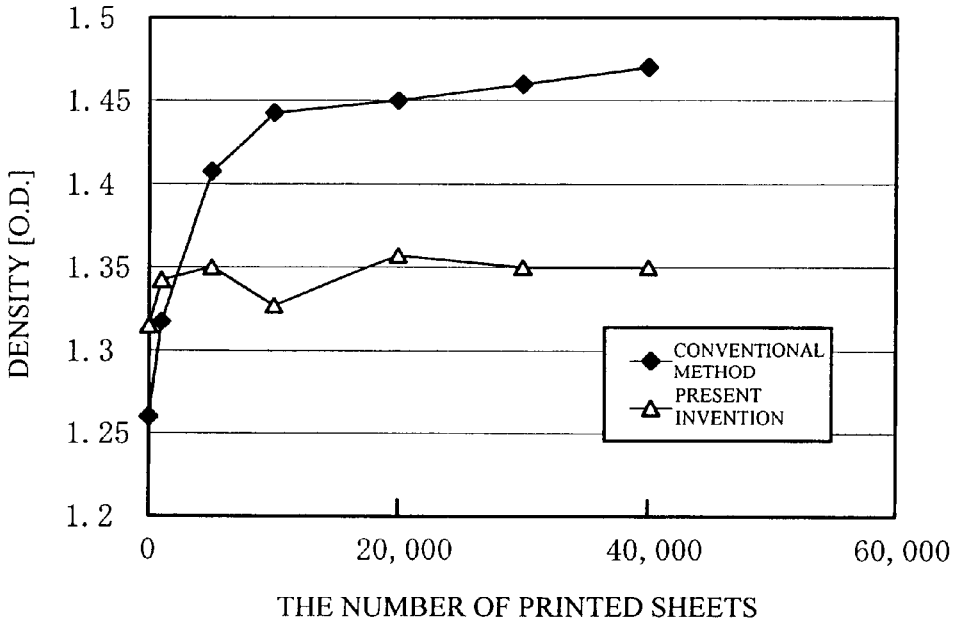
FIG. 6 is a graph for showing a relationship between the number of printed sheets and a solid image density.
Figure 7:
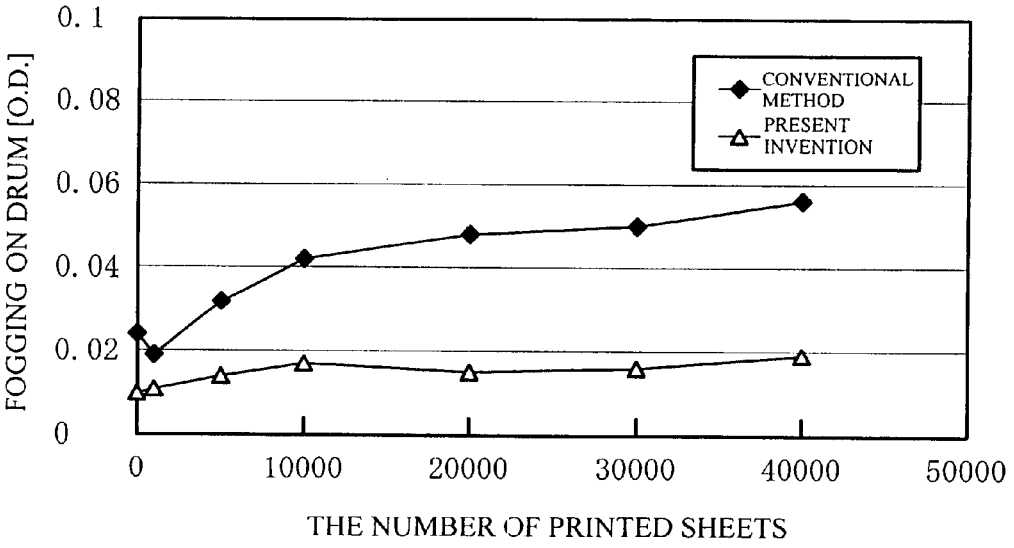
FIG. 7 is a graph for showing a relationship between the number of printed sheets and fogging on the drum.
Figure 8:
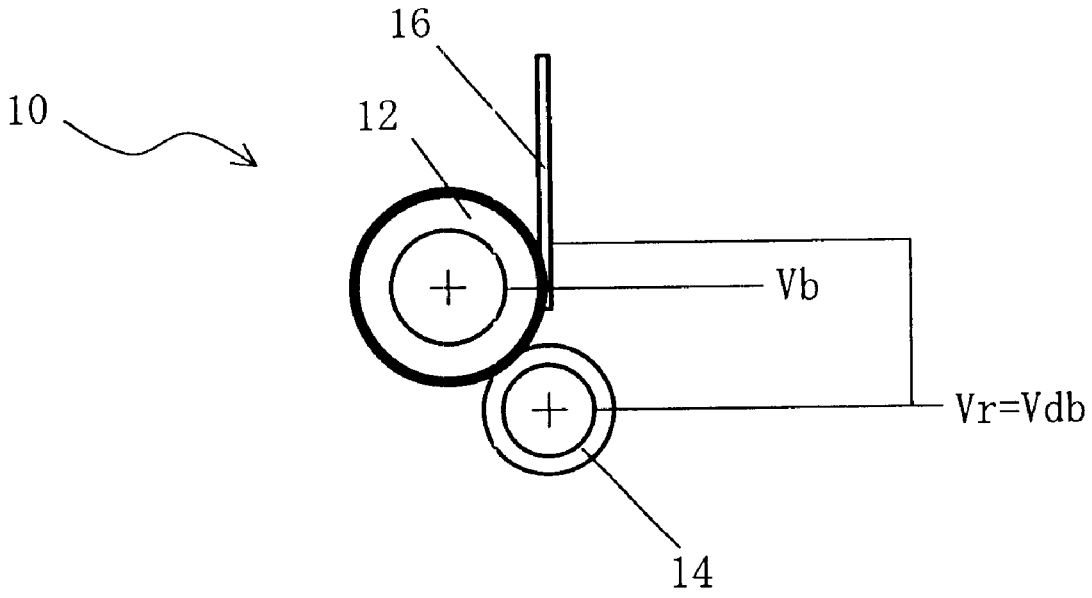
FIG. 8 PRIOR ART
FIG. 8 is a schematic sketch of a principal part of a conventional development device for explaining a bias applied to the development device.

An image-formation experiment 2 was carried out using the image-forming device 200 according to the present invention. The experimental conditions were the same, except for the resistance R set at 100 kΩ, as those in the experiment 1, and a relationship (as a running property) between the number of printed sheets and the image-forming capability was determined. By contrast, the resultant image properties obtained in the image-forming device including the conventional development device 10 are shown as well. In this experiment, the image-forming capability was evaluated by measuring a solid image density and fogging on the drum. The results are shown in FIGS. 6 and 7. The solid image density and fogging were measured using the O.D. meter as in the experiment 1. FIG. 6 is a graph for showing a relationship between the number of printed sheets and the solid image density. FIG. 7 is a graph for showing a relationship between the number of printed sheets and the fogging on the drum.

As seen in FIGS. 6 and 7, in the conventional image-forming device, the solid image density and the fogging on the drum increase as the number of printed sheets increases. This is because the toner T deteriorates (its charging property and fluidity lower) as the number of printed sheets increases, which increases a thickness of the toner layer TL. Particularly, in the conventional development device 10, it is conceived that a bias is applied to the blade 16 so as to increase the amount of deposited toner T, and thus the thickness of the toner layer TL considerably increases as the amount of charges in the toner T decreases, thereby increasing the solid image density and the fogging on the drum.

On the other hand, in the image-forming device 200 according to the present invention, even if the number of printed sheets increases, the solid image density and the fogging on the drum vary less. This is because the development roller 120 and the blade 130 has the same level of potential, and further includes the resistance 135; therefore the toner layer TL is stably formed irrespective of the amount of charges in the toner T (e.g., even if the toner T deteriorates).

As described above, the results of the experiments 1 and 2 indicate that the formation of the toner layer TL without depending upon variation of the toner charge amount as has been deemed a challenge in the art may be realized. Accordingly, the present invention would reduce image retention (positive ghost) in an early stage of printing operations where the number of printed sheets is small yet, and further reduce fogging due to deterioration of the toner T, thereby increasing the lifespan of the development device 100 including the toner T.

Although the preferred embodiments of the present invention have been described above, various modifications and changes may be made in the present invention without departing from the spirit and scope thereof. For instance, it is to be understood that the scope of application of the present invention is not limited to the contact-type development method using the nonmagnetic monocomponent developing agent, but the present invention is applicable to the noncontact-type development method using the nonmagnetic monocomponent developing agent. Furthermore, the present invention is also applicable to the nonmagnetic dual-component developing agent, and the magnetic developing agent.

As described above, the inventive development device and development method, and image-forming device utilizes a resistance directly or indirectly provided between a blade and a bias power supply that applies a bias to the blade, and thus can stably form a toner layer irrespective of the number of printed sheets. Accordingly, the occurrence of image retention (positive ghost) that may occurs in an early stage of printing operations, and fogging due to deterioration of toner, and the like may be reduced; therefore a high-quality image may be formed irrespective of the number of printed sheets. Problems due to the toner deterioration may also be reduced, and thus the toner, development device and image-forming device may have prolonged lifespan.

What is claimed is:

1. A development device comprising:

a development roller, a surface of which is made of electrically resistant material;

a blade that comes in contact with the development roller so as to form a layer of developing agents, and has a predetermined thickness on the development roller, and possesses electrical conductivity;

a development bias power supply that applies a bias to the development roller and the blade;

a reset roller that feeds developing agent to the development roller and collects residual developing agents on the development roller by utilizing a potential difference; and a resistor provided between the blade and the development bias supply to establish electric connection therebetween, said resistor having a resistance R determining $\tau=C_T(R_D+R)$ where $C_T$ is an equivalent capacitance of the layer of developing agents at a contact region having a nip width between said development roller and said blade, $R_D$ is an equivalent resistance of said development roller, and $\tau$ is a time constant of a closed circuit including a capacitor corresponding to the layer of developing agents having the equivalent capacitance, said resistor, and a resistor corresponding to said development roller having the equivalent resistance $R_D$, said resistance R being smaller than 100 MΩ, and the time constant $\tau$ being larger than a time period for said development roller to run by the nip width between said development roller and said blade.

2. A development device according to claim 1, wherein the resistance ranges between 50 kΩ and 100 MΩ.

3. A development device according to claim 1, wherein the developing agents are nonmagnetic monocomponent developing agents.

4. A development method comprising:

a reset roller to which a voltage is applied feeding developing agents to a development roller to which a voltage is applied, by utilizing a potential difference;

bringing a blade to which a voltage is applied into contact with the development roller, and forming a uniform layer of the developing agents charged by triboelectricity, the blade being connected with a resistor;

a development process of feeding the developing agents from the development roller disposed in contact with the photosensitive drum to the photosensitive drum, and visualizing latent images with the developing agents on the photosensitive drum; and the reset roller collecting residual developing agents on the development roller utilizing a potential difference, wherein said resistor having a resistance R determining $\tau=C_T(R_D+R)$ where $C_T$ is an equivalent capacitance of the layer of developing agents at a contact region having a nip width between said development roller and said blade, $R_D$ is an equivalent resistance of said development roller, and $\tau$ is a time constant of a closed circuit including a capacitor corresponding to the layer of developing agents having the equivalent capacitance, said resistor, and a resistor corresponding to said development roller having the equivalent resistance $R_D$, said resistance R being smaller than 100 MΩ and the time constant $\tau$ being larger than a time period for said development roller to run by the nip width between said development roller and said blade.

5. An image-forming device comprising:

a photosensitive drum;

a charger that charges the photosensitive drum;

an exposure part that exposes the photosensitive body charged by the charger to light, and forms an electrostatic latent image;

a development device that develops the photosensitive body exposed to light, and visualizes the electrostatic latent image into a toner image; and a transfer part that transfers the toner image onto a recordable medium, wherein the development device comprises:

a development roller a surface of which is made of electrically resistant material;

a blade that comes in contact with the development roller so as to form a layer of developing agents, and has a predetermined thickness on the development roller, and possesses electrical conductivity;

a bias power supply that applies a bias to the development roller and the blade; and a resistor provided between the blade and the development bias supply to establish electric connection therebetween, said resistor having a resistance R determining $\tau=C_T(R_D+R)$ where $C_T$ is an equivalent capacitance of the layer of developing agents at a contact region having a nip width between said development roller and said blade, $R_D$ is an equivalent resistance of said development roller, and $\tau$ is a time constant of a closed circuit including a capacitor corresponding to the layer of developing agents having the equivalent capacitance, said resistor, and a resistor corresponding to said development roller having the equivalent resistance $R_D$, said resistance R being smaller than 100 MΩ and the time constant $\tau$ being larger than a time period for said development roller to run by the nip width between said development roller and said blade.

6. An image-forming device comprising:

a photosensitive drum;

a charger that charges the photosensitive drum;

an exposure part that exposes the photosensitive body charged by the charger to light, and forms an electrostatic latent image;

a development device that develops the photosensitive body exposed to light, and visualizes the electrostatic latent image into a toner image; and a transfer part that transfers the toner image onto a recordable medium, wherein the development device comprises:

a development roller a surface of which is made of electrically resistant material;

a blade that comes in contact with the development roller so as to form a layer of developing agents, and has a predetermined thickness on the development roller;

a development bias power supply that applies the same bias to the development roller and the blade; and said blade incorporating an elastic and electrically resistant material that is directly electrically connected with the development bias power supply.

7. An image-forming device according to claim 6, wherein the elastic resistant material ranges between 50 kΩ and 100 MΩ.

* * * * *